United States Patent [19]

Harrington et al.

[11] 4,232,901

[45] Nov. 11, 1980

[54] ADJUSTABLE OTTOMAN

[76] Inventors: Elaine M. Harrington, 708 44th St., Des Moines, Iowa 50312; Paul C. Menning, 1624 E. 24th St., Des Moines, Iowa 50317

[21] Appl. No.: 84,316

[22] Filed: Oct. 12, 1979

[51] Int. Cl.[3] ..... A47C 9/12; A47C 25/00

[52] U.S. Cl. ..... 297/439; 108/147; 297/DIG. 10; 297/437; 297/462

[58] Field of Search ..... 297/439, 462, 437, 461, 297/339, DIG. 10; 248/421, 422; 108/147; 296/65 R; 4/185 L; 5/63, 66

[56] References Cited

U.S. PATENT DOCUMENTS

| | | | |
|---|---|---|---|
| 1,846,607 | 2/1932 | Nicholas | 248/421 X |
| 2,579,577 | 12/1951 | Hill | 297/461 X |
| 2,706,237 | 4/1955 | Hare et al. | 297/462 X |
| 3,237,921 | 3/1966 | Jay | 108/1 47 X |
| 3,528,717 | 9/1970 | Kinnebrew | 297/439 X |
| 3,716,876 | 2/1973 | Petzon et al. | 5/66 X |
| 3,817,096 | 12/1974 | Roth | 4/185 L |

*Primary Examiner*—James T. McCall

*Attorney, Agent, or Firm*—Robert W. Carlson

[57] ABSTRACT

The invention comprises an ottoman with means for automatically elevating the cushioned top of the ottoman to any desired height. The ottoman includes remote control means for actuating the elevating means.

8 Claims, 6 Drawing Figures

ADJUSTABLE OTTOMAN

BACKGROUND

The concept of an adjustable foot stool or ottoman is in itself not novel as illustrated by Hill, U.S. Pat. No. 2,579,577. However, such a device as well as others known in the prior art have many disadvantages for universal satisfaction and acceptance. The prior art devices suffice adequately in situations where the user is capable of raising the ottoman to a predetermined height, sitting down and testing such height to determine if it is desirable and if not, thereafter arising from the chair and readjusting the height. If the user is incapacitated in some manner so as to be unable to move about in such a manner, assistance from another person is necessary.

Presently there is considerable demand for furniture and appliances which make life easier and more comfortable for an individual. The present invention certainly qualifies as a comfort luxury. More important, however, the present invention was conceived as an aid to those who suffer permanent disabilities. More particularly, those who, because of a variety of diseases or physical disorders, must spend a considerable amount of their waking hours in a sitting position are confronted with a circulatory problem. Because of the fact that their legs are substantially immobilized, circulation of the blood presents a very prominent medical problem as well as a personal discomfort.

In most instances it is most desirable to elevate the legs to assist circulation through the legs. However, all elevations of the legs are not necessarily the same beneficial results to all people. Therefore, it is most desirable to provide a mechanism with which a user may at his or her comfort adjust the elevation of the support mechanism to any height which is comfortable.

THE INVENTION

The present invention overcomes the disadvantages of the prior art devices. Therefore, it is an object of this invention to provide a foot rest which may be adjusted by the user while seated.

It is a further object of this invention to provide an adjustable foot rest which is an attractive piece of furniture at all times.

It is still a further object of this invention to provide an adjustable foot rest which may be adjusted to a plurality of positions.

Referring now to the specification and drawings in which.

The ottoman 10 comprises a box like base 12 having vertically extending walls 13 which may be formed of finished wood or other decorative materials. Similar to most ottomans, a soft cushion top 14 is provided and may be upholstered with a variety of materials and in many varied colors. Casters 16 are provided so that the ottoman can be easily moved about.

Figure 2:
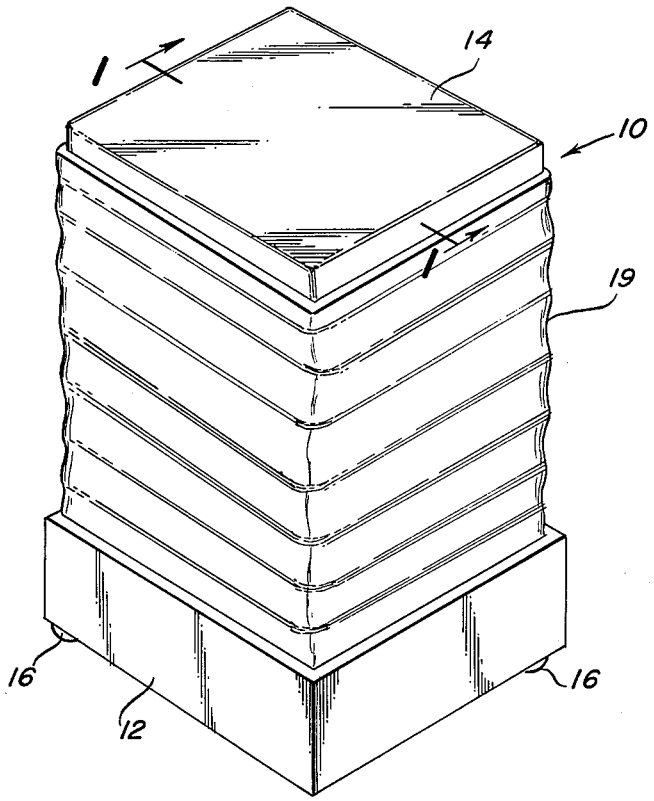
FIG. 2 is a perspective view of the ottoman in its elevated position.
Figure 4:
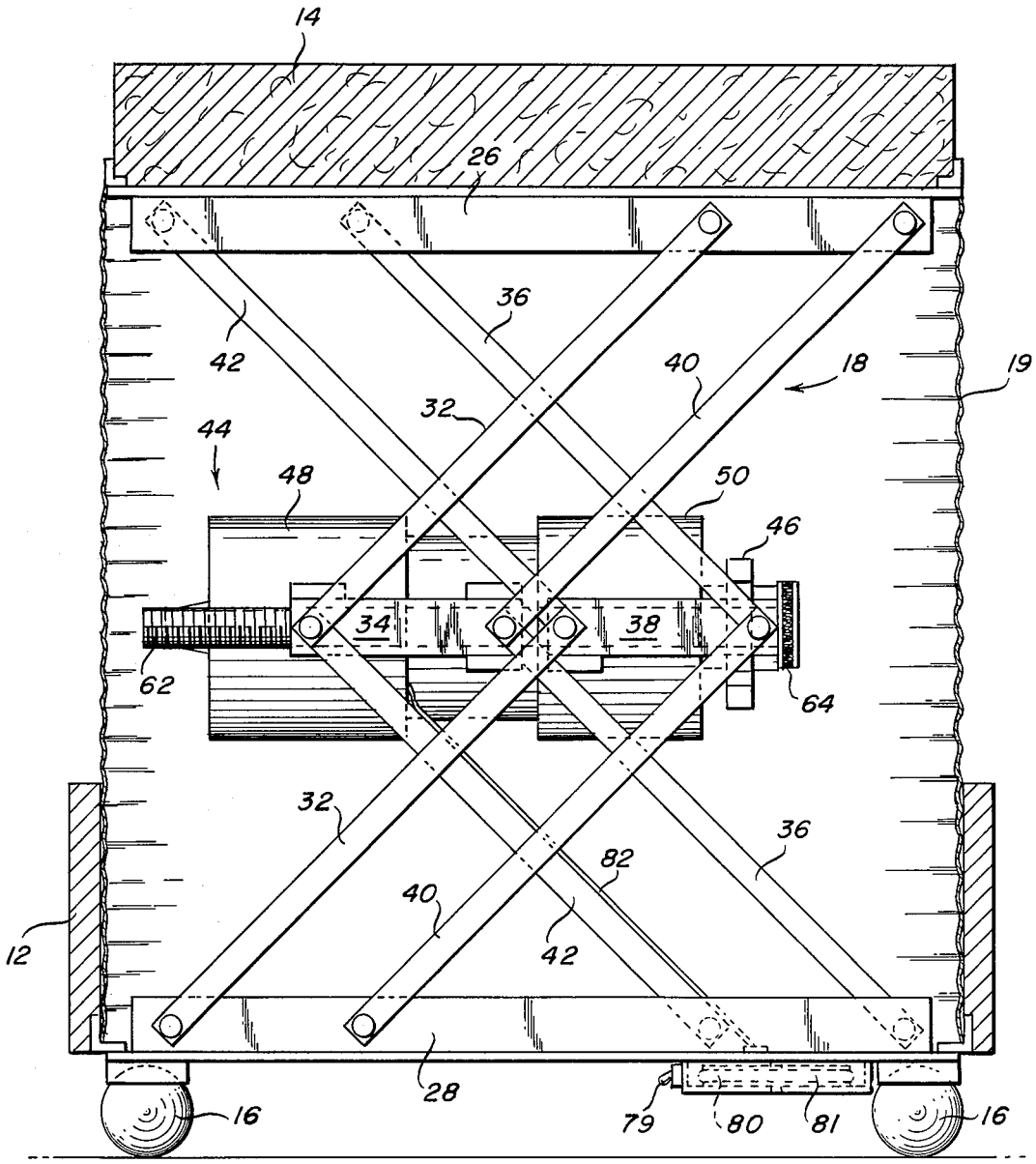
FIG. 4 is a sectional view taken on line 1—1 of FIG. 2.

The elevating mechanism 18 is completely contained within the base 12 below the tops of the walls 13 when the ottoman is in its normal position. When the cushion 14 is elevated a skirt 19 depends from the periphery of the cushion 14 to the interior of the base 12 as best shown in FIGS. 2 and 4. The skirt 19 may be formed in any conventional manner but is illustrated as comprised of accordian pleated fabric 20 matching the cushion 14. The pleated fabric 20 will fold up and be housed in the base 12 beneath the cushion 14 when the ottoman is in its lowermost or normal position.

The elevating mechanism 18 comprises a pair of lazy-tong mechanisms 24 and 24'. Since the lazy-tong mechanisms are identical it will suffice to describe only one in detail.

The lazy-tong mechanism comprises a cushion supporting beam 26 and a base beam 28 which is rigidly secured to the bottom 30 of the base 12. A pair of links 32 are pivotally connected to the beam 26 adjacent one end thereof and extend therefrom to a bar 34 where they are pivotally secured to opposite ends of the bar 34. A further pair of links 36 are pivotally secured adjacent the other end of the beam 26 and extend therefrom to a bar 38 where they are pivotally secured to opposite ends of the bar 38.

The bar 34 is supported by a pair of links 42 which are pivotally secured to opposite ends of the bar 34. The pair of links 42 are pivotally connected to the base beam 28 adjacent one end thereof. In a similar manner, the bar 38 is supported by a pair of links 40 pivotally secured at opposite ends of the bar 34 and pivotally secured adjacent the opposite end of the beam 28.

Figure 3:
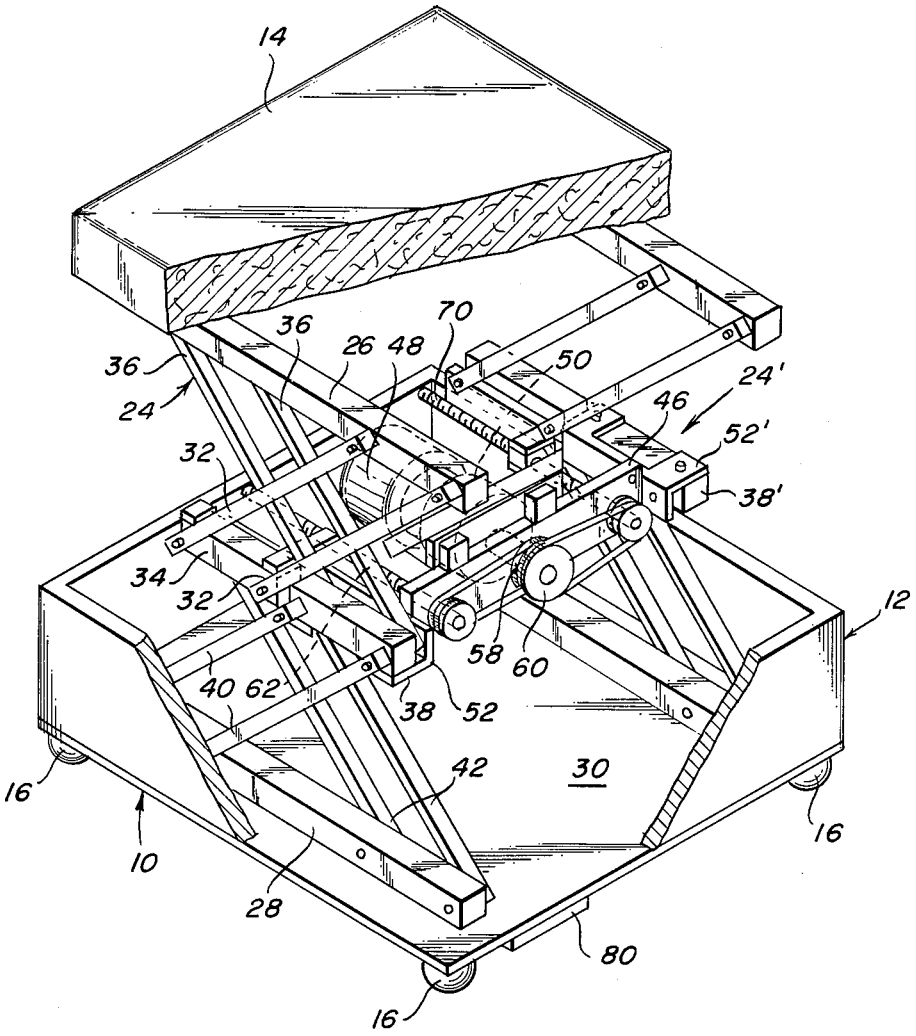
FIG. 3 is an elevational view, partially in section, of the ottoman in its elevated position.
Figure 5:
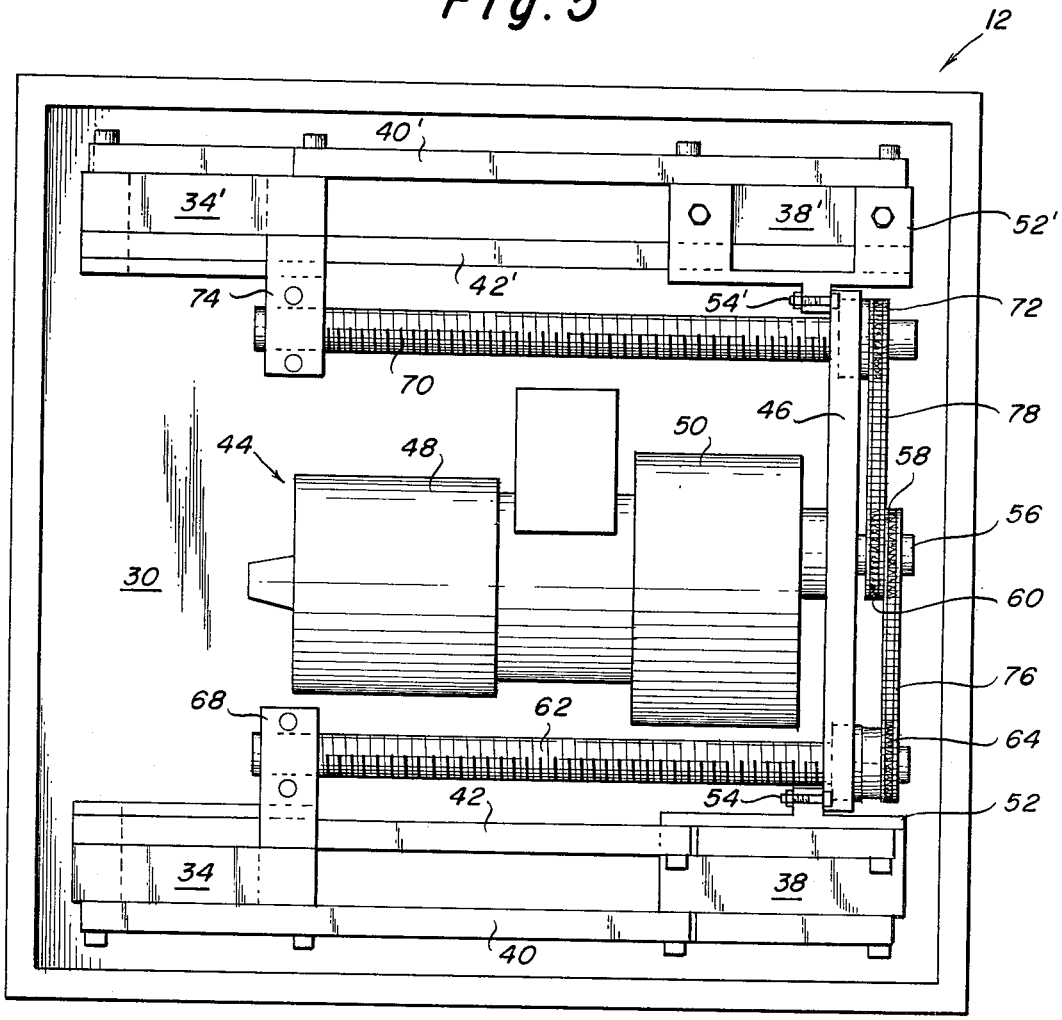
FIG. 5 is a sectional view taken on line 2—2 of FIG. 1.

An electric drive system 44 is supported solely by an elongated plate 46 which extends between the two bars 38 and 38'. The drive system 44 comprises an electric motor 48 and a gear reduction means 50, as best illustrated in FIG. 5. The ends of the plate 46 are rigidly secured to L-shaped clips 52 by bolts 54 and 54' or other suitable means. For simplicity of manufacturing, the L-shaped clips are identical and may be secured to the bars 38 by welding. As best seen in FIG. 3, one clip 52 is secured to the bottom of the bar 38 and the clip 52' is secured to the top of the bar 38'.

The drive shaft 56 is journaled in and extends through the plate 46. A pair of sprockets 58 and 60 are secured on the end of the drive shaft 56.

A first threaded rod 62 is rotatably journaled in the plate 46 adjacent one end thereof and extends therethrough a sufficient distance so that a sprocket 64 may be secured to its end. The other end of the rod 62 is supported in a nut 68 rigidly secured to the bar 34 by any suitable means. A second threaded rod 70 is rotatably journaled in the plate 46 adjacent the opposite end thereof and extends therethrough a sufficient distance so that a sprocket 72 may be secured to its end. The other end of the rod 70 is supported in a nut 74 rigidly secured to the bar 34' in the same manner as the nut 68.

A first drive chain 76 extends between the sprocket 58 and the sprocket 64 mounted on the drive shaft 56 and a second drive chain 78 extends between the sprocket 72 and the sprocket 60 also mounted on the drive shaft 46.

Figure 6:
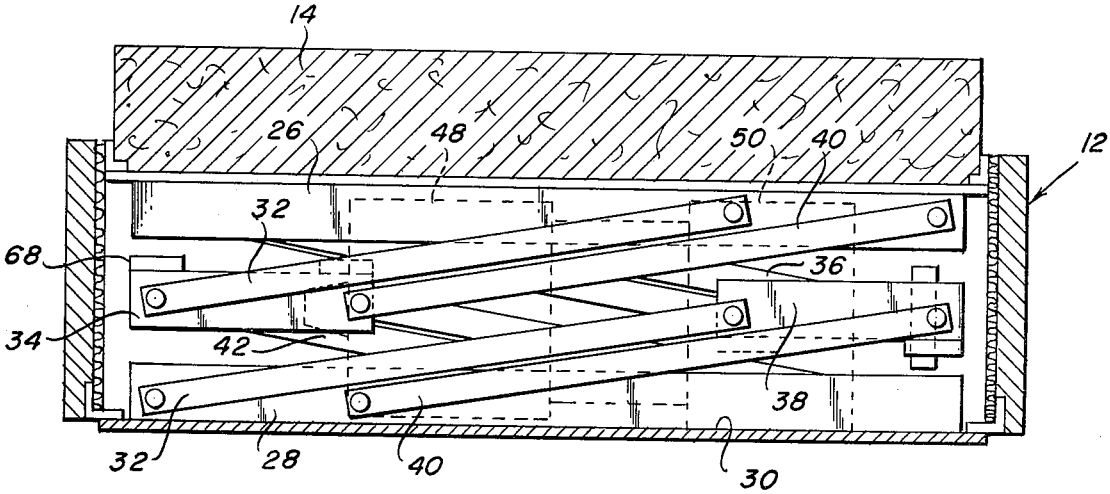
FIG. 6 is a sectional view taken on line 3—3 of FIG. 1.

It will now be understood that upon actuation of the drive system, the sprockets 58 and 60 will be rotated to drive the chains 76 and 78 which rotate sprockets 64 and 72 and their associated rods 62 and 70, respectively. Rotation of the rods 62 and 70 in one direction in the nuts 68 and 74 causes the bars 34 and 34' to move toward the bars 38 and 38'. Due to the lazy-tong arrangement, the bars 38 and 38' will simultaneously be moved toward the bars 34 and 34'. As the bars 34, 34' and 38, 38' move towards each other, they pivot the linkages 40, 40'; 42, 42'; 32, 32'; and 36, 36' from a substantially horizontal position as illustrated in FIG. 6 to an inclined position as illustrated in FIG. 3. During such movement the bars 34, 34' and 38, 38' will also be moved vertically. Such movement will elevate the cushion 14. Rotation of the drive system in the opposite direction will cause the bars 34, 34' and 38, 38' to move away from each other thus lowering the cushion 14. The electric drive system 44 being supported solely on the plate 46, will move both horizontally and vertically with the bars 38, 38'.

Figure 1:
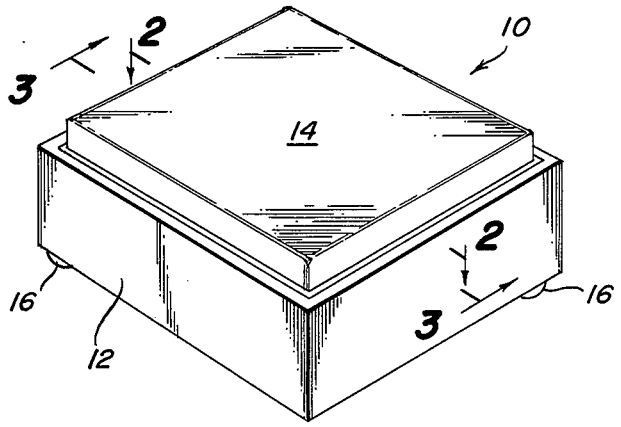
FIG. 1 is a perspective view of the ottoman in its normal position.

The control means for operating the drive system may comprise of a hand operated switch 79 mounted on a retractable cord 80, similar to that utilized on vacuum cleaners, stored in a housing 81 secured under the ottoman. The cord 80 is connected with a further cord 82 which is connected to the electric motor 48. With this arrangement, the cushion 14 may be adjusted to a desired position by merely actuating the switch 79 until such position is obtained. The skirt 19 hides all of the elevating mechanism 18 when the cushion 14 is elevated as illustrated in FIG. 2. When the cushion is fully lowered, the elevating mechanism 18 and the skirt are housed with the base 12 entirely concealed from sight as illustrated in FIG. 1. If desired, the control means could comprise radio frequency responsive means such as utilized in television sets.

It will be understood from the foregoing that the present invention not only provides an attractive comfort aid but also provides a practical therapeutic mehanism.

Having described the ottoman in detail, it will be apparent that changes and modifications will occur to those skilled in the art and all of which may fall within the spirit and scope of the appended claims.

What is claimed is:

1. An adjustable foot rest comprising a base, elevating mechanism housed within said base, said elevating mechanism including an electric motor, a cushion supported on said elevating means and switch means for actuating said electric motor to raise and lower said cushion, said elevating mechanism comprising a pair of spaced apart lazy-tong assemblies and said electric motor being supported solely by a member extending between said spaced apart lazy-tong assemblies so that said electrical motor is adapted to move both vertically and horizontally.

2. An adjustable foot rest as set forth in claim 1 including skirt means depending from said cushion when said cushion is in an elevated position.

3. An adjustable foot rest as set forth in claim 1 wherein said actuating switch is connected to said base by retractible means so that said switch may be actuated from a position remote from said foot rest.

4. An adjustable foot rest as set forth in claim 1 wherein said base is provided with a plurality of casters so that said foot rest may be easily moved about.

5. An adjustable foot rest as set forth in claim 1 wherein said base comprises a box-like housing having walls of sufficient height so that when said cushion is in its lowermost position, all of the elevating means is hidden from sight.

6. An adjustable foot rest as set forth in claim 1 wherein said elevating means includes a pair of threaded rods, one being connected to each of said lazy-tong assemblies.

7. An adjustable foot rest as set forth in claim 6 including flexible drive means operatively connecting said electric motor with said threaded rods.

8. An adjustable foot rest as set forth in claim 7 including a pair of nuts threadably receiving said threaded rods so that upon rotation of said rods, said nuts operate to extend or retract said lazy-tong assemblies.

* * * * *